US008090273B2

(12) United States Patent
Derimiggio

(10) Patent No.: US 8,090,273 B2
(45) Date of Patent: Jan. 3, 2012

(54) CUSTOM APPLICATION FUSER ROLLER SYSTEM

(75) Inventor: John E. Derimiggio, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 639 days.

(21) Appl. No.: 12/254,063

(22) Filed: Oct. 20, 2008

(65) Prior Publication Data

US 2010/0098440 A1 Apr. 22, 2010

(51) Int. Cl.
*G03G 15/00* (2006.01)
*G03G 15/20* (2006.01)

(52) U.S. Cl. ..... 399/12; 399/67

(58) Field of Classification Search ..... 399/12, 399/67, 81, 82
See application file for complete search history.

(56) References Cited

U.S. PATENT DOCUMENTS

| | | | | |
|---|---|---|---|---|
| 6,016,409 | A | 1/2000 | Beard et al. | 399/33 |
| 6,438,329 | B1 | 8/2002 | Budnik et al. | 399/24 |
| 6,940,613 | B1 * | 9/2005 | Beard et al. | 399/12 |
| 7,146,112 | B2 | 12/2006 | Phipps et al. | 399/12 |
| 7,197,633 | B2 | 3/2007 | Rommelmann et al. | 713/1 |
| 7,224,912 | B2 | 5/2007 | Rommelmann et al. | 399/8 |
| 7,231,153 | B2 | 6/2007 | May | 399/25 |
| 7,307,531 | B2 | 12/2007 | Rommelmann et al. | 340/572.1 |
| 7,859,412 | B2 * | 12/2010 | Kothari et al. | 340/572.1 |
| 7,916,031 | B2 * | 3/2011 | Kothari et al. | 340/572.1 |
| 2006/0257155 | A1 | 11/2006 | Schlafer et al. | 399/12 |
| 2007/0252718 | A1 | 11/2007 | Ray | 340/679 |
| 2007/0252719 | A1 | 11/2007 | Ray | 340/679 |

* cited by examiner

*Primary Examiner* — William J Royer
(74) *Attorney, Agent, or Firm* — Alix, Yale & Ristas, LLP

(57) ABSTRACT

A fuser roller system, utilized with electrographic or xerographic copying or printing devices, multiple fuser rollers, each of which includes a machine readable device (MRD) having identification data. The system also includes at least one MRD reader and at least one computer having a database of fuser rollers. The system facilitates use of custom fuser rollers by determining what type of fuser roller is appropriate to run a print job. Then it is determined whether an appropriate fuser roller is installed in the copying or printing device. If an appropriate fuser roller is installed in the copying or printing device, the print job is directed to the device. If an appropriate fuser roller is not installed in the copying or printing device, the appropriate fuser roller is identified using the identification data stored in the MRD and installed in the device.

27 Claims, 5 Drawing Sheets

CUSTOM APPLICATION FUSER ROLLER SYSTEM

BACKGROUND

This disclosure relates generally to printing machines. More particularly, the present disclosure relates to fuser assemblies for electrographic or xerographic copying or printing devices.

In a typical electrographic or xerographic copying or printing process, a charge retentive surface such as a photoconductive member is charged to a substantially uniform potential so as to sensitize the surface thereof. The charged portion of the photoconductive member is selectively exposed to light to dissipate the charges thereon in areas subjected to the light. This records an electrostatic latent image on the photoconductive member. After the electrostatic latent image is recorded on the photoconductive member, the electrostatic latent image is rendered visible by bringing one or more developer materials into contact therewith. Generally, the developer material comprises toner particles adhering triboelectrically to carrier granules. The toner particles are attracted from the carrier granules either to a donor member or to a latent electrostatic image on the photoconductive member. When attracted to a donor member, the toner particles are subsequently deposited on the latent electrostatic images. The toner powder image is then transferred from the photoconductive member to a final substrate or imaging media. The toner particles forming the toner powder images are then subjected to a combination of heat and/or pressure to permanently affix the powder images to the substrate.

A fuser assembly is commonly used to heat the toner material and cause it to fuse to the substrate. The assembly includes a fuser roller that rotates around an axis as the substrate is drawn between it and a pressure roller. Heat is applied to the toner material via the fuser roller during this drawing process. Fuser rollers typically operate at temperatures up to approximately 200° C.

In high quality production printing it is extremely difficult to design a fuser roller that is optimum for all the possible applications that may be seen. As a result compromises and tradeoffs have to be made in the fuser roller design so that acceptable performance is achieved over the wide range of jobs that may be run. The result is higher cost and perhaps lower quality output than otherwise would have been achieved if a fuser roller was available that was specifically tailored for the particular application.

The main obstacles to implementing custom application fuser rollers are the difficulty in managing the inventory of custom fuser rollers that would be required and preventing the wrong roller being used for the application being run.

SUMMARY

There is provided a fuser roller system utilized with electrographic or xerographic copying or printing devices. The system comprises multiple fuser rollers and/or fuser modules, each of which includes a machine readable device (MRD) having identification data. The system also includes at least one MRD reader and at least one computer. The computer has a database of fuser rollers and/or fuser modules.

A MRD reader may be associated with each copying or printing device.

The database may include a record for each type of fuser roller used in the copying or printing devices. The database records may include a description of the fuser roller and the type of print job for which the fuser roller is used. The database records may include data to identify the fuser rollers installed in the copying or printing devices.

The database records may include data identifying a specific copying or printing device in which one of the installed fuser rollers is installed. Alternatively, the database may include data describing the physical location of each fuser roller in inventory.

There is also provided a method of using a fuser roller system at a location having at least one electrographic or xerographic copying or printing device and a plurality of fuser rollers adapted for use in the copying or printing device. The method comprises determining what type of fuser roller is appropriate to run a print job and determining whether an appropriate fuser roller is installed in the copying or printing device. If the copying or printing device has an appropriate fuser roller installed therein, the print job is directed to the copying or printing device. If the copying or printing device does not have an appropriate fuser roller installed therein, the appropriate fuser roller is installed in the copying or printing device.

Determining the appropriate type of fuser roller comprises querying a print job program for the fuser roller requirements.

Determining whether an appropriate fuser roller is installed in one of the copying or printing devices comprises querying a database to determine whether the fuser roller installed in the copying or printing device conforms with the print job program fuser roller requirements.

If the fuser roller installed in the copying or printing device does not conform with the print job program fuser roller requirements, determining whether an appropriate fuser roller is installed in one of the copying or printing devices may further comprise displaying a message stating that an appropriate fuser roller is not installed in the copying or printing device. The message may also include a location of at least one fuser roller that conforms with the print job program fuser roller requirements or information on the type of fuser roller that should be installed.

Determining whether an appropriate fuser roller is installed in one of the copying or printing devices may further comprise displaying a message stating that multiple fuser rollers conform with the print job program fuser roller requirements and requesting an operator to select one of the conforming fuser rollers for installation in the copying or printer device.

Determining whether an appropriate fuser roller is installed in one of the copying or printing devices may further comprise determining an optimum fuser roller from multiple fuser rollers conforming with the print job fuser roller requirements and displaying a message stating that multiple fuser rollers conform with the print job program fuser roller requirements and identifying the optimum fuser roller.

Installing the appropriate fuser roller comprises confirming a selected fuser roller by reading identification data stored in a machine readable device of the selected fuser roller with a MRD reader. A database is queried to determine what type of fuser roller is associated with the identification data read from the selected fuser roller. The type of fuser roller appropriate to run the print job is determined and it is determined whether the selected fuser roller is an appropriate fuser roller. If it is an appropriate fuser roller, the selected fuser roller is installed in the copying or printing device. If the selected fuser roller is not an appropriate fuser roller, a subsequent selected fuser roller is identified and confirmed.

Determining the appropriate type of fuser roller comprises querying a print job program for the fuser roller requirements.

Determining whether the selected fuser roller is an appropriate fuser roller comprises determining whether the selected fuser roller conforms with the print job program fuser roller requirements.

Identifying a subsequent selected fuser roller may comprise displaying a message stating that the selected fuser roller is not an appropriate fuser roller. The message may include a location of at least one fuser roller that conforms with the print job program fuser roller requirements or information on the type of fuser roller that should be installed.

Identifying a subsequent selected fuser roller may comprise displaying a message stating that multiple fuser rollers conform with the print job program fuser roller requirements and requesting an operator to select one of the conforming fuser rollers for installation in the copying or printer device.

Identifying a subsequent selected fuser roller may comprise determining an optimum fuser roller from multiple fuser rollers conforming with the print job fuser roller requirements and displaying a message stating that multiple fuser rollers conform with the print job program fuser roller requirements and identifying the optimum fuser roller.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

Figure 1:
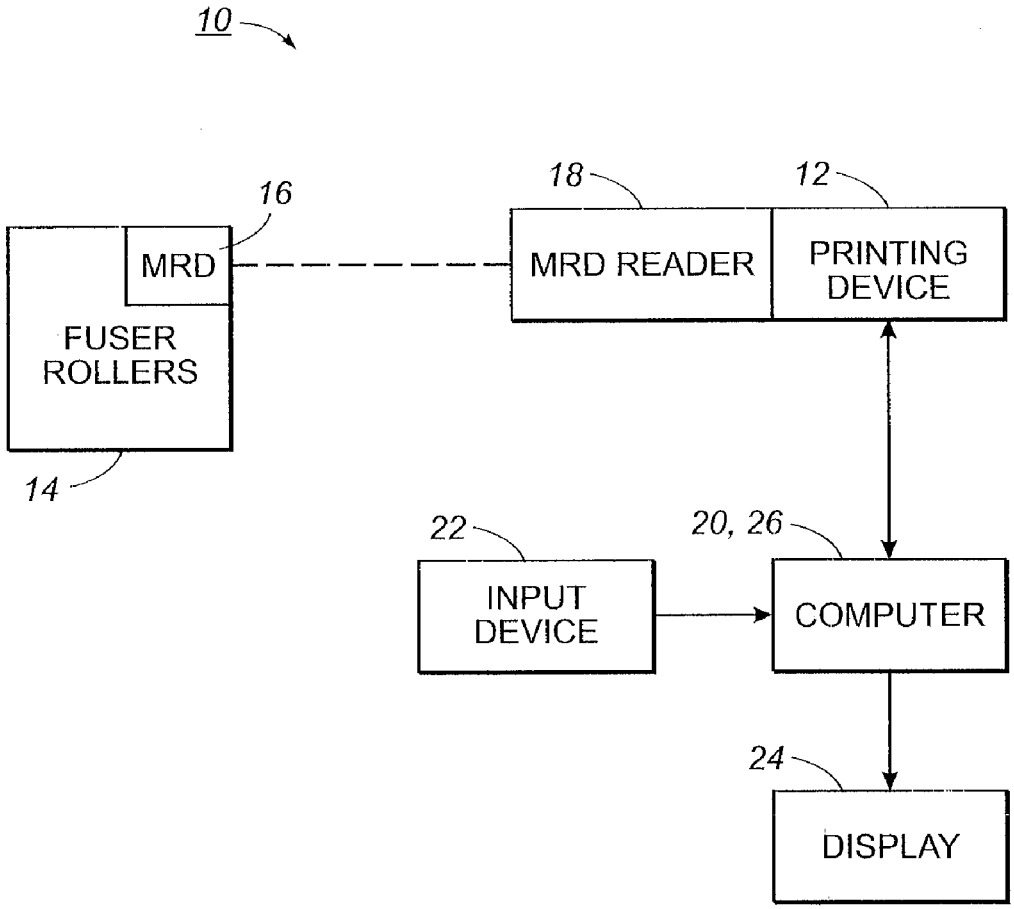
FIG. 1 is schematic diagram of a fuser roller system in accordance with the disclosure.

With reference to the drawings wherein like numerals represent like parts throughout the several figures, a fuser roller system in accordance with the present disclosure is generally designated by the numeral 10. The fuser roller system 10 is utilized with electrographic or xerographic copying or printing devices 12, allowing custom application fuser rollers 14 and/or fuser modules 15 to be installed therein. Examples of custom application fuser rollers 14 include fuser rollers optimized for edge wear when used with predominantly heavier weight paper stocks and high creep rollers optimized for very lightweight paper stocks.

Figure 5:
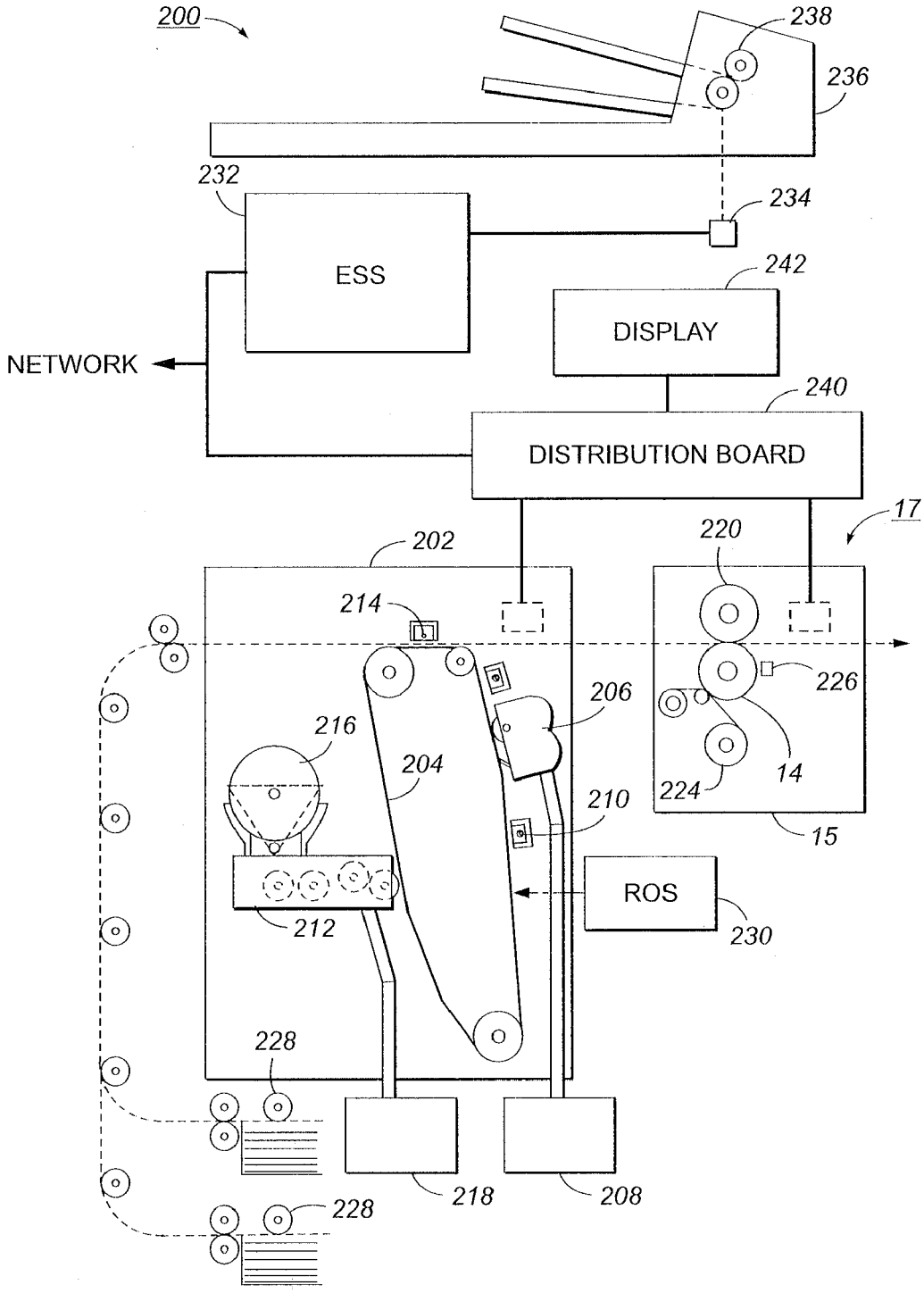
FIG. 5 is a simplified, partially-elevational, partially-schematic view of an electrophotographic printing apparatus in which the aspects of the fuser roller system can be embodied.

FIG. 5 is a simplified partially-elevational, partially-schematic view of an electrophotographic printing apparatus 12, in this case a combination digital copier/printer 200, in which many of the aspects of the fuser roller system 10 can be embodied. The two main portions of hardware in the printing apparatus include a "xerographic module" indicated as 202, and a "fuser module" indicated as 15. As is familiar in the art of electrographic printing, there is contained within xerographic module 202 many of the essential hardware elements required to create desired images electrographically. The images are created on the surface of a rotating photoreceptor 204 which is mounted on a set of rollers, as shown. Disposed at various points around the circumference of photoreceptor 204 are a cleaning device generally indicated as 206, which empties into a "toner reclaim bottle" 208, a charging corotron 210 or equivalent device, a developer unit 212, and a transfer corotron 214. Of course, in any particular embodiment of an electrophotographic printer, there may be variations on this general outline, such as additional corotrons, or cleaning devices, or, in the case of a color printer, multiple developer units.

With particular reference to developer unit 212, as is familiar in the art, the unit 212 generally comprises a housing in which a supply of unit developer (which typically contain toner particles plus carrier particles) which can be supplied to an electrostatic latent image created on the surface of photoreceptor 204 or other charge receptor. Developer unit 212 may be made integral with or separable from xerographic module 202; and in a color-capable embodiment of the fuser roller system 10, there would be provided multiple developer units 212, each unit developing the photoreceptor 204 with a different primary-color toner. A toner bottle 216, which could contain either pure toner or an admixture of carrier particles, continuously or selectably adds toner or developer into the main body of developer unit 212. In one particular embodiment of an electrophotographic printer, there is further supplied a developer receptacle here indicated as 218, which accepts excess developer directly from the housing of developer unit 212. In this particular embodiment, the developer receptacle 218 should be distinguished from the toner reclaim bottle 208, which reclaims untransferred toner from the cleaning device 206. Thus, in the illustrated embodiment, there are two separate receptacles for used or excess developer and toner.

Turning to fuser module 15, there is included in the present embodiment all of the essential elements of a subsystem for fusing a toner image which has been electrostatically transferred to a sheet by the xerographic module 202. A "fuser module" 15 is hereby defined to be a fuser roller in combination with a "fuser module subassembly" 17, where the fuser module subassembly 17 includes the elements of a fuser module 15 other than the fuser roller. As such, the fuser module subassembly 17 includes a pressure roller 220, and a web supply 224, which provides a release agent to the outer surface of fuser roller 14 so that paper passing between fuser roller 14 and pressure roller 220 does not stick to the fuser roller 14. Also typically included in a fuser module subassembly is a thermistor such as 226 for monitoring the temperature of a relevant portion of the subsystem.

Paper or other medium on which images are desired to be printed are retained on one or more paper stacks. Paper is drawn from the stacks, typically one sheet at a time, by feed rolls such as indicated as 228. When it is desired to print an image on a sheet, a motor (not shown) activates one of the feed rolls 228, depending on what type of sheet is desired, and the drawn sheet is taken from the stack and moved through a paper path, shown by the dot-dash line in FIG. 5, where it eventually comes into contact with the photoreceptor 204 within xerographic module 202. At the transfer corotron 214, the sheet receives an unfused image, as is known in the art. The sheet then passes further along the paper path through a nip formed between pressure roller 220 and fuser roller 14. The fuser subsystem thus causes the toner image to be permanently fixed to the sheet, as is known in the art.

In a digital printing apparatus, whether in the form of a digital printer or in a digital copier, images are created by selectably discharging pixel-sized areas on the surface of photoreceptor 204 immediately after the surface is generally charged such as by charging corotron 210. Typically, this selective discharging is performed by a raster output scanner (ROS) indicated as 230, which, as is known, includes a modulating laser which reflects a beam off a rotating reflective polygon. Other apparatus for imagewise discharging of the photoreceptor 204, such as an LED bar or ionographic head, are also known. The image data operative of the ROS 230 or other apparatus typically generated by what is here called an "electronic subsystem" or ESS, here indicated as 232. (For clarity, the necessary connection between ESS 232 and ROS 230 is not shown.)

The ESS 232 can receive original image data either from a personal computer, or one of several personal computers or other apparatus on a network, or, in the case where the apparatus is being used as a digital copier, via a photosensor bar here indicated as 234. Briefly, the photosensor bar 234 typically includes a linear array of pixel-sized photosensors, on which a sequence of small areas on an original hard-copy image are focused. The photosensors in the array convert the dark and light reflected areas of the original image into electrical signals, which can be compiled and retained by ESS 232, ultimately for reproduction through ROS 230.

If the apparatus is being used in digital copier mode, it is typically desired to supply an original document handler, here generally indicated as 236, to present either or both sides of a sequence of hard-copy original pages to the photosensor bar 234. As is familiarly known, a document handler 236 such as may include any number of rollers, nudgers, and the like, one of which is here indicated as 238.

There is further provided within an electrophotographic printing/copying apparatus, what is here called a "distribution board" 240. The distribution board 240 can send or receive messages, as will be described below, through the same network channels as ESS 232, or alternately through a telephone or facsimile line (not shown); alternately, the distribution board 240 can cause messages to be displayed through a display 242, typically in the form of a touch screen disposed on the exterior of the apparatus.

With reference to FIG. 1, fuser rollers 14, fuser modules 15 and/or fuser module subassemblies 17 utilized in the fuser roller system 10 include a machine readable device (MRD) 16. The MRD 16 may be an integral component of the fuser roller 14, fuser module 15, and/or fuser module subassembly 17, a device attached to the fuser roller 14, fuser module 15, and/or fuser module subassembly 17, or printed on the fuser roller 14, fuser module 15, and/or fuser module subassembly 17. The MRD 16 includes identification data that may be used to identify the type of fuser roller 14, fuser module 15, and/or fuser module subassembly 17 of which it is a component. In one example, the identification data may be a description of the roller/module/module subassembly type. Alternatively, the identification data may be a serial number or other unique identifier, as explained in greater detail below.

Examples of such machine readable devices 16 are optical devices such as barcodes and electronic data storage devices. An "electronic data storage device" (EDSD) is a machine-readable device capable of storing electronic data. An EDSD may also be machine-writeable. Electronic data storage device refers to a single electronic data storage device as well as to a collection of two or more electronic data storage devices connected, for example, in series, in parallel, or nested one within another. Examples of electronic data storage devices include, but are not limited to, radio frequency identification tags (RFID tags), proximity (Prox) tags, iButtons, smartcards, and similar devices. Radio frequency identification (RFID) is a method of remotely storing and retrieving data using devices called RFID tags/transponders. An RFID tag is a small object, such as an adhesive sticker, that can be attached to or incorporated into a product. RFID tags contain antennas to enable them to receive and respond to radio-frequency queries from an RFID transceiver.

The fuser roller system 10 also includes at least one MRD reader 18 and at least one computer 20. A MRD reader 18 may be associated with each printing device 12, a single centrally located MRD reader 18 may be used, or a limited number of MRD readers 18 may be distributed throughout the workplace. Similarly, a computer 20 may be associated with each printing device 12, a single centrally located computer 20 may be used, or a limited number of computers 20 may be distributed throughout the workplace. Generally, each of the computers 20 will include a computer input device 22 and a visual display 24.

The computer 20 includes a database 26 of fuser rollers 14, fuser modules 15 and/or fuser module subassemblies. Generally, this database 26 includes a record for each type of fuser roller 14, fuser module 15 and/or fuser module subassembly 17 used in the printing devices 12, with the records including a description of the fuser roller 14, fuser module 15 and/or fuser module subassembly 17 and the type of print job for which it is used. The database 26 may include data for identifying which fuser rollers 14, fuser modules 15 and/or fuser module subassemblies 17 are installed in the printing devices 12, and may further include data identifying the specific printing device 12 in which the fuser roller 14, fuser module 15 and/or fuser module subassembly 17 is installed. Alternatively, the database 26 may include data describing the physical location of each fuser roller 14, fuser module 15 and/or fuser module subassembly 17 in inventory. The fuser roller records may include the fuser power and voltage requirements. That is, the voltage and power requirements required to operate the particular fuser roller. The fuser module and/or fuser module subassembly records may include the maximum allowable web usage for the fuser module/fuser module subassembly. That is, the maximum cumulative amount of use, either in terms of length or number of prints made, of the fuser cleaning web within the fuser module/fuser module subassembly. The fuser roller records, the fuser module records or the fuser module subassembly records may include machine speed code(s). In a product family, a design option is to provide essentially the same hardware across different-speed products, e.g., the same basic machine, including the same basic design of replaceable modules, can be sold in either a 40 ppm (page-per-minute) or 60 ppm version. The machine speed code relating to whether a fuser roller 14, a fuser module 15 or a fuser module subassembly 17 is suitable for use at a particular speed (or both speeds).

Figure 2:
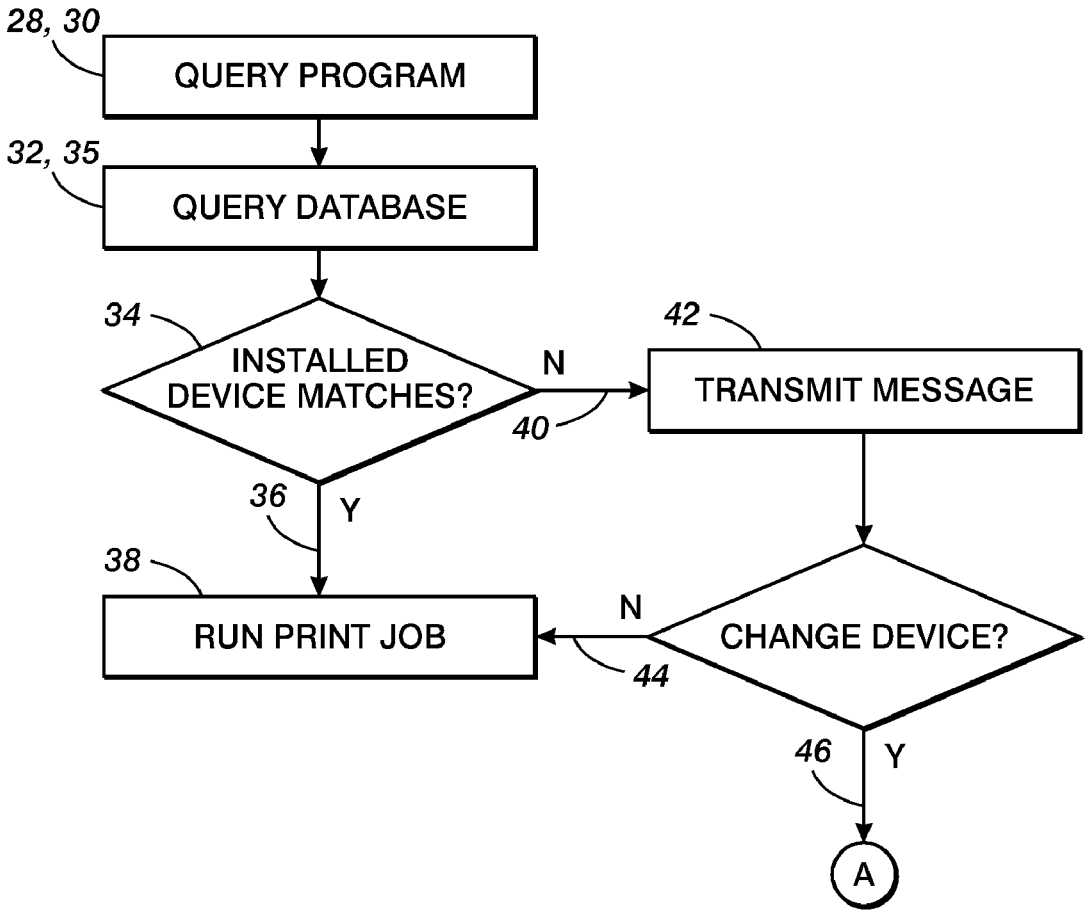
FIGS. 2, 3 and 4 are flow diagrams of a method of using a fuser roller system in accordance with the disclosure.

With reference to FIG. 2, the fuser roller system 10 prevents using a fuser roller 14, or a fuser module 15 in a printing operation for which it is inappropriate, and facilitates selection of the optimum fuser roller 14 or fuser module 15 when several fuser rollers 14 or fuser modules 15 may be appropriate in a printing operation. The "optimum fuser roller" or "optimum fuser module" is hereby defined to be the fuser roller 14 or fuser module 15 that is best suited for a specified printing operation among the fuser rollers 14 or fuser modules 15 that are available in inventory. If the database 26 includes data identifying which fuser rollers 14 and/or fuser modules 15 are installed in each printing device 12 or describing the physical location of each fuser roller 14 and/or fuser module 15 in inventory, the computer 20 will query 28 the print job program for the fuser roller requirements to determine 30 what type of fuser roller 14 or fuser module 15 should be used to run the print job and then query 32 the database 26 to determine 34 whether an appropriate fuser roller 14 or fuser module 15 is installed in one of the printing devices 12. If more than one type of fuser roller 14 or fuser module 15 is appropriate for use, the computer 20 may determine 35 whether one of these fuser rollers 14 or fuser modules 15 is the optimum fuser roller/fuser module for the print job. If the optimum fuser roller 14 or fuser module 15 is installed 36 in one of the printing devices 12, the print job is directed to that printing device 12 for production 38 of the print job.

If an appropriate fuser roller 14 or fuser module 15 is not installed 40 in any of the printing devices 12, the computer transmits 42 a message to a display device 24 informing the operator that an appropriate fuser roller 14 or fuser module 15 should be installed in one of the printing devices 12. The message may include the location of an appropriate fuser roller 14 or fuser module 15 that is held in inventory and/or information on the type of fuser roller 14 or fuser module 15 that should be installed. The print job program may allow the operator to direct 44 the print job to one of the printing devices 12 even if it does not have an appropriate fuser roller 14 or fuser module 15 installed.

If more than one fuser roller 14 or fuser module 15 may be appropriate and in inventory, the computer 20 may transmit 42 a message to a display device 24 requesting the operator to decide which of the appropriate fuser rollers 14 or fuser modules 15 may be optimum for the print job. If the optimum fuser roller 14 or fuser module 15 is installed in one of the printing devices 12, the operator then directs 44 the print job to that printing device 12 for production 38 of the print job. If the optimum fuser roller 14 or fuser module 15 is not installed in one of the printing devices 12, the operator may decide to install 46 the optimum fuser roller 14 or fuser module 15 in one of the printing devices 12 or direct 44 the print job to a printing device 12 having a non-optimum but appropriate fuser roller 14 or fuser module 15 installed therein.

Figure 4:
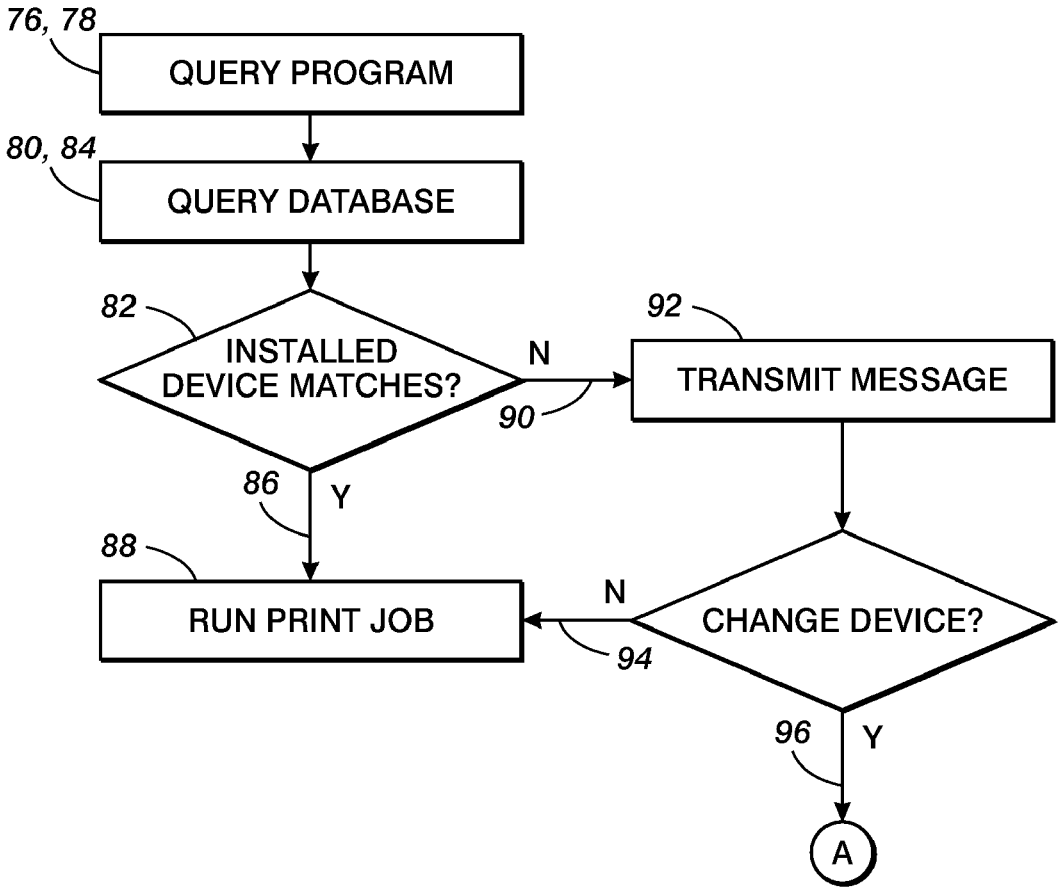

If the fuser module subassemblies 17 of the fuser modules 15 utilized in a printing device 12 are designed to accept custom fuser rollers 14, the fuser roller system 10 may facilitate selection of the optimum combination of fuser roller 14 and fuser module subassembly 17, FIG. 4. That is, the combination of the fuser roller 14 and fuser module subassembly 17 that are best suited for a specified printing operation among the fuser rollers 14 and fuser module subassemblies 17 that are available in inventory.

The computer 20 will query 76 the print job program for the fuser roller requirements to determine 78 what type of fuser roller 14 and fuser module subassembly 17 should be used to run the print job and then query 80 the database 26 to determine 82 whether an appropriate fuser roller 14 and fuser module subassembly 17 are installed in one of the printing devices 12. If more than one type of fuser roller 14 or fuser module subassembly 17 is appropriate for use, the computer 20 may determine 84 whether one of these fuser rollers 14 or fuser modules 15 is the optimum fuser roller/fuser module for the print job. If the optimum fuser roller 14 and fuser module subassembly 17 are both installed 86 in one of the printing devices 12, the print job is directed to that printing device 12 for production 88 of the print job.

If an appropriate fuser roller 14 and/or an appropriate fuser module subassembly 17 are not installed 90 in any of the printing devices 12, the computer transmits 92 a message to a display device 24 informing the operator that an appropriate fuser roller 14 and/or fuser module subassembly 17 should be installed in one of the printing devices 12. The message may include the location of an appropriate fuser roller 14 and fuser module subassembly 17 that is held in inventory and/or information on the type of fuser roller 14 and fuser module subassembly 17 that should be installed. In the case that one of the fuser module subassembly 17 or the fuser roller 14 installed in a printing device 12 is appropriate for a print job but not the other, the message may provide the location of the printing device 12. The print job program may allow the operator to direct 94 the print job to one of the printing devices 12 even if it does not have an appropriate fuser roller 14 and fuser module subassembly 17 installed.

If more than one fuser roller 14 and fuser module subassembly 17 may be appropriate and in inventory, the computer 20 may transmit 92 a message to a display device 24 requesting the operator to decide which of the appropriate fuser rollers 14 and fuser modules 15 may be optimum for the print job. If the optimum fuser roller 14 and the optimum fuser module subassembly 17 are both installed in one of the printing devices 12, the operator then directs 94 the print job to that printing device 12 for production 88 of the print job. If the optimum fuser roller 14 and the optimum fuser module subassembly 17 are not installed in one of the printing devices 12, the operator may decide to install 96 the optimum fuser roller 14 and the optimum fuser module subassembly 17 in one of the printing devices 12 and direct the print job to a printing device 12 having a non-optimum but appropriate fuser roller 14 and fuser module subassembly 17 installed therein.

Figure 3:
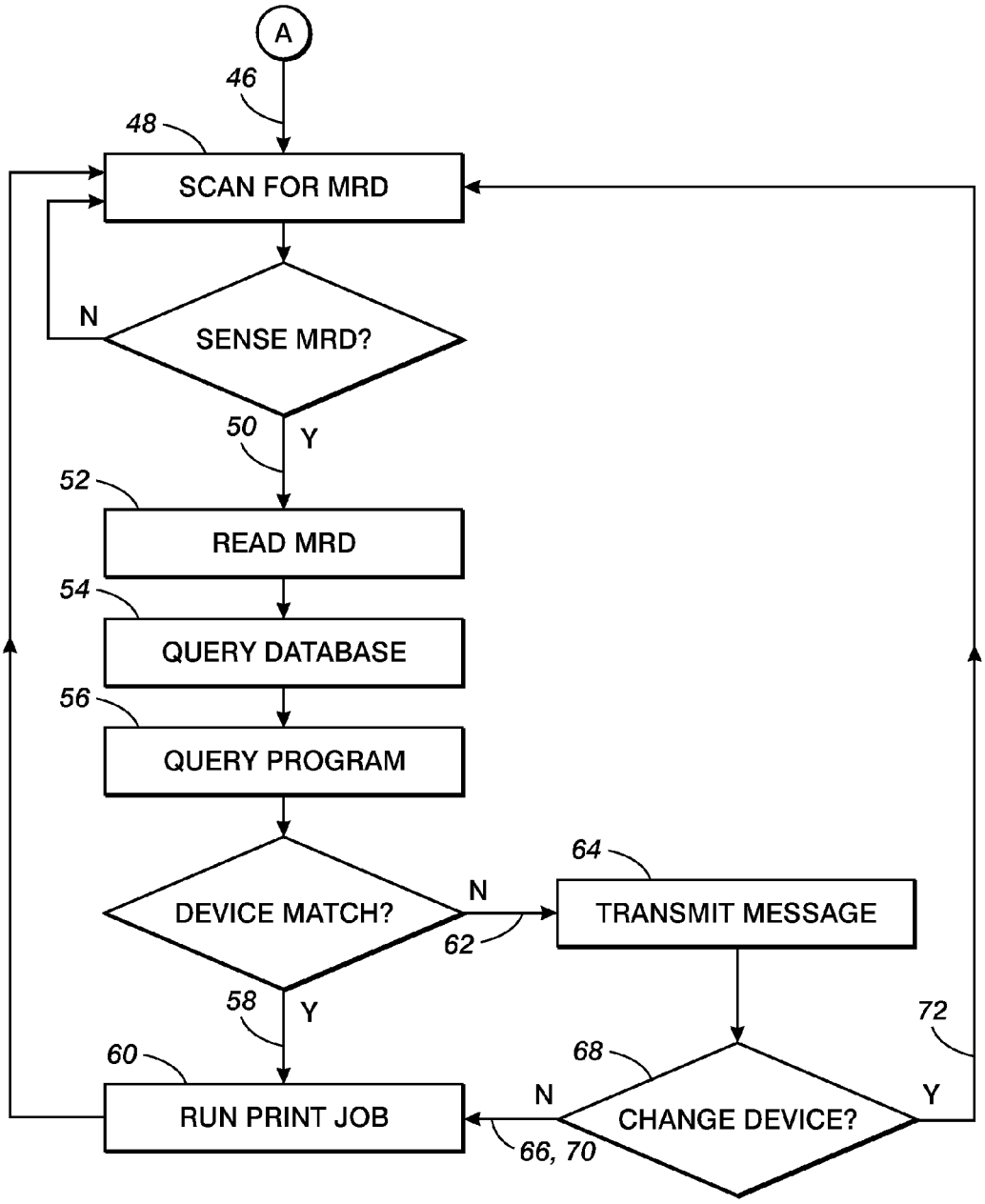

As described above, the fuser roller system 10 includes at least one MRD reader 18. With reference to FIG. 3; if a fuser roller 14, fuser module 15 and/or fuser module subassembly 17 must be installed 46 in one of the printing devices 12 in order to perform a print job, or if the identity of a fuser roller 14, fuser module 15 and/or fuser module subassembly 17 installed in one of the printing devices 12 must be verified, the fuser roller 14, fuser module 15 and/or fuser module subassembly 17 or the MRD reader 18 is positioned such that the MRD 16 associated with the fuser roller 14, fuser module 15 and/or fuser module subassembly 17 may be sensed and scanned 48 by the MRD reader 18. If the MRD reader 18 cannot sense the MRD 16, the fuser roller 14, fuser module 15 and/or fuser module subassembly 17 or the MRD reader 18 may have to be repositioned or a problem with the MRD 16 or the MRD reader 18 corrected. If the MRD 16 is sensed 50 by the MRD reader 18, the MRD reader 18 then scans the MRD 16 to read 52 the data stored therein. The computer 20 queries 54 the database 26 to determine the type of fuser roller 14, fuser module 15 and/or fuser module subassembly 17 that has been scanned and then queries 56 the print job program to determine what type of fuser roller 14, fuser module 15 and/or fuser module subassembly 17 should be used to run the print job. If the fuser roller 14, fuser module 15 and/or fuser module subassembly 17 is the optimum fuser roller 14, fuser module 15 and/or fuser module subassembly 17 for the print job, the operator installs 58 the fuser roller 14, fuser module 15 and/or fuser module subassembly 17 in one of the printing devices 12 and the print job is directed 60 to that printing device 12.

If the fuser roller 14, fuser module 15 and/or fuser module subassembly 17 is not 62 an appropriate fuser roller 14, fuser module 15 and/or fuser module subassembly 17, the computer 20 transmits 64 a message to a display device 24 informing the operator of that fact. The message may include the location of an appropriate fuser roller 14, fuser module 15 and/or fuser module subassembly 17 that is held in inventory and/or information on the type of fuser roller 14, fuser module 15 and/or fuser module subassembly 17 that should be installed. The print program may allow the operator to direct 66 the print job to one of the printing devices 12 even if it does not have an appropriate fuser roller 14, fuser module 15 and/or fuser module subassembly 17 installed.

If more than one fuser roller 14, fuser module 15 and/or fuser module subassembly 17 may be appropriate and/or in inventory, the computer 20 may transmit 64 a message to a display device 24 requesting the operator to decide 68 which of the appropriate fuser rollers 14 and/or fuser module 15 may be optimum for the print job. The operator may decide to install 70 the fuser roller 14, fuser module 15 and/or fuser module subassembly 17 that has been scanned in one of the printing devices 12 for use in the print run or select 72 another fuser roller 14, fuser module 15 and/or fuser module subassembly 17 for verification by scanning 48.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fuser roller system utilized with electrographic or xerographic copying or printing devices, the system comprising:

a plurality of fuser rollers, each of the fuser rollers including a machine readable device having identification data;

at least one MRD reader; and at least one computer, the computer having a database of fuser rollers.

2. The fuser roller system of claim 1 wherein a MRD reader is associated with each copying or printing device.

3. The fuser roller system of claim 1 wherein the database includes a record for each type of fuser roller used in the copying or printing devices.

4. The fuser roller system of claim 3 wherein the database records include a description of the fuser roller and the type of print job for which the fuser roller is used.

5. The fuser roller system of claim 4 wherein the database records include data to identify the fuser rollers installed in the copying or printing devices.

6. The fuser roller system of claim 5 wherein the database records further include data identifying a specific copying or printing device in which one of the installed fuser rollers is installed.

7. The fuser roller system of claim 4 wherein the database includes data describing the physical location of each fuser roller in inventory.

8. A method of using a fuser roller system at a location having at least one electrographic or xerographic copying or printing device and a plurality of fuser rollers or fuser modules adapted for use in the copying or printing device, the method comprising:

determining what type of fuser roller or fuser module is appropriate to run a print job;

determining whether an appropriate fuser roller or fuser module is installed in the copying or printing device; and directing the print job to the copying or printing device if the copying or printing device has an appropriate fuser roller or fuser module installed therein; or installing the appropriate fuser roller or fuser module in the copying or printing device if the copying or printing device does not have an appropriate fuser roller or fuser module installed therein.

9. The method of claim 8 wherein determining the appropriate type of fuser roller or fuser module comprises querying a print job program for the fuser roller or fuser module requirements.

10. The method of claim 8 wherein determining whether an appropriate fuser roller or fuser module is installed in one of the copying or printing devices comprises querying a database to determine whether the fuser roller or fuser module installed in the copying or printing device conforms with a print job program fuser roller or fuser module requirements.

11. The method of claim 10 wherein determining whether an appropriate fuser roller or fuser module is installed in one of the copying or printing devices further comprises displaying a message stating that an appropriate fuser roller or fuser module is not installed in the copying or printing device, if the fuser roller or fuser module installed in the copying or printing device does not conform with the print job program fuser roller or fuser module requirements.

12. The method of claim 11 wherein the message also includes:

a location of at least one fuser roller or fuser module that conforms with the print job program fuser roller or fuser module requirements; or information on the type of fuser roller or fuser module that should be installed.

13. The method of claim 10 wherein determining whether an appropriate fuser roller or fuser module is installed in one of the copying or printing devices further comprises displaying a message stating that multiple fuser rollers or fuser modules conform with the print job program fuser roller requirements; and requesting an operator to select one of the conforming fuser rollers or fuser modules for installation in the copying or printer device.

14. The method of claim 10 wherein determining whether an appropriate fuser roller or fuser module is installed in one of the copying or printing devices further comprises:

determining an optimum fuser roller or fuser module from a plurality of fuser rollers or fuser modules conforming with the print job fuser roller requirements; and displaying a message stating that multiple fuser rollers or fuser modules conform with the print job program fuser roller requirements, and identifying the optimum fuser roller or fuser module.

15. The method of claim 8 wherein each of the fuser rollers or fuser modules includes a machine readable device having identification data associated with the fuser roller or fuser module, and wherein installing the appropriate fuser roller or fuser module comprises:

confirming a selected fuser roller or fuser module by:

reading the identification data stored in the machine readable device of the selected fuser roller or fuser module with a MRD reader, querying a database to determine what type of fuser roller or fuser module is associated with the identification data read from the machine readable device of the selected fuser roller or fuser module, determining what type of fuser roller or fuser module is appropriate to run a print job, determining whether the selected fuser roller or fuser module is an appropriate fuser roller or fuser module; and preparing the copying or printing device by:

installing the selected fuser roller or fuser module in the copying or printing device if it is an appropriate fuser roller or fuser module, or identifying a subsequent selected fuser roller if the selected fuser roller or fuser module is not an appropriate fuser roller or fuser module, and confirming the subsequent selected fuser roller or fuser module.

16. The method of claim 15 wherein reading the identification data comprises:

sensing a machine readable device; and scanning the machine readable device with the MRD reader.

17. The method of claim 15 wherein determining the appropriate type of fuser roller or fuser module comprises querying a print job program for the fuser roller or fuser module requirements.

18. The method of claim 15 wherein determining whether the selected fuser roller or fuser module is an appropriate fuser roller or fuser module comprises determining whether the selected fuser roller or fuser module conforms with a print job program fuser roller or fuser module requirements.

19. The method of claim 15 wherein identifying a subsequent selected fuser roller or fuser module comprises displaying a message stating that the selected fuser roller or fuser module is not an appropriate fuser roller or fuser module.

20. The method of claim 19 wherein the message also includes:

a location of at least one fuser roller or fuser module that conforms with a print job program fuser roller or fuser module requirements; or information on the type of fuser roller or fuser module that should be installed.

21. The method of claim 15 wherein identifying a subsequent selected fuser roller or fuser module comprises displaying a message stating that multiple fuser rollers or fuser modules conform with a print job program fuser roller or fuser module requirements; and requesting an operator to select one of the conforming fuser rollers or fuser modules for installation in the copying or printing device.

22. The method of claim 15 wherein identifying a subsequent selected fuser roller or fuser module comprises:

determining an optimum fuser roller or fuser module from a plurality of fuser rollers or fuser module conforming with a print job fuser roller or fuser module requirements; and displaying a message stating that multiple fuser rollers or fuser modules conform with the print job program fuser roller or fuser module requirements, and identifying the optimum fuser roller or fuser module.

23. A method of using a fuser roller system at a location having at least one electrographic or xerographic copying or printing device and a plurality of fuser module subassemblies adapted for use in the copying or printing device and a plurality of fuser rollers adapted for use in the fuser module subassemblies, the method comprising:

determining what type of fuser roller and fuser module subassembly are appropriate to run a print job;

determining whether an appropriate fuser roller and fuser module subassembly are installed in the copying or printing device; and directing the print job to the copying or printing device if the copying or printing device has an appropriate fuser roller and fuser module subassembly installed therein; or installing the appropriate fuser roller or the appropriate fuser module subassembly in the copying or printing device if the copying or printing device does not have an appropriate fuser roller or an appropriate fuser module subassembly installed therein.

24. The method of claim 23 wherein determining the appropriate type of fuser roller and fuser module subassembly comprises querying a print job program for the fuser roller and fuser module subassembly requirements.

25. The method of claim 23 wherein determining whether an appropriate fuser roller and fuser module subassembly is installed in one of the copying or printing devices comprises querying a database to determine whether the fuser roller and fuser module subassembly installed in the copying or printing device conforms with the print job program fuser roller and fuser module subassembly requirements.

26. The method of claim 25 wherein determining whether an appropriate fuser roller and fuser module subassembly is installed in one of the copying or printing devices further comprises:

determining an optimum fuser roller and fuser module subassembly from a plurality of fuser rollers and fuser module subassemblies conforming with a print job fuser roller and fuser module subassembly requirements; and displaying a message stating that multiple fuser rollers and fuser module subassemblies conform with a print job program fuser roller requirements, and identifying the optimum fuser roller and fuser module subassembly.

27. The method of claim 23 wherein each of the fuser rollers and fuser module subassemblies includes a machine readable device having identification data associated with the fuser roller and fuser module subassembly, and wherein installing the appropriate fuser roller or fuser module subassembly comprises:

confirming a selected fuser roller and fuser module subassembly by:

reading the identification data stored in the machine readable device of the selected fuser roller and fuser module subassembly with a MRD reader, querying a database to determine what type of fuser roller and fuser module subassembly is associated with the identification data read from the machine readable device of the selected fuser roller and fuser module subassembly, determining what type of fuser roller and fuser module subassembly is appropriate to run a print job, determining whether the selected fuser roller and fuser module subassembly is an appropriate fuser roller and fuser module subassembly; and preparing the copying or printing device by:

installing the selected fuser roller and fuser module subassembly in the copying or printing device if it is an appropriate fuser roller and fuser module subassembly, or identifying a subsequent selected fuser roller if the selected fuser roller and fuser module subassembly is not an appropriate fuser roller and fuser module subassembly, and confirming the subsequent selected fuser roller and fuser module subassembly.

* * * * *